US008985188B2

(12) United States Patent
Shibata et al.

(10) Patent No.: US 8,985,188 B2
(45) Date of Patent: Mar. 24, 2015

(54) CORE PIN FOR CASTING

(75) Inventors: Kiyoshi Shibata, Tokyo (JP); Akihiro Ikegami, Tokyo (JP); Masayuki Numata, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/110,954

(22) PCT Filed: Feb. 29, 2012

(86) PCT No.: PCT/JP2012/055048
§ 371 (c)(1),
(2), (4) Date: Oct. 10, 2013

(87) PCT Pub. No.: WO2012/140965
PCT Pub. Date: Oct. 18, 2012

(65) Prior Publication Data

US 2014/0027085 A1 Jan. 30, 2014

(30) Foreign Application Priority Data

Apr. 12, 2011 (JP) ..... 2011-088106

(51) Int. Cl.
*B22C 9/10* (2006.01)
*B22D 17/22* (2006.01)
*B22C 9/06* (2006.01)

(52) U.S. Cl.
CPC ..... *B22C 9/103* (2013.01); *B22D 17/2218* (2013.01); *B22C 9/06* (2013.01); *B22C 9/10* (2013.01); *B22C 9/106* (2013.01); *B22C 9/101* (2013.01)
USPC ..... 164/348; 164/369

(58) Field of Classification Search
CPC ..... B22C 9/06; B22C 9/10; B22C 9/101; B22C 9/103; B22C 9/106; B22D 17/2218
USPC ..... 164/348, 122, 340, 369
See application file for complete search history.

(56) References Cited

U.S. PATENT DOCUMENTS

| | | | | |
|---|---|---|---|---|
| 4,940,074 | A * | 7/1990 | Menard | 164/412 |
| 6,435,258 | B1 * | 8/2002 | Ogasawara et al. | 164/128 |
| 6,634,410 | B1 * | 10/2003 | Wilson et al. | 164/35 |

FOREIGN PATENT DOCUMENTS

| | | | |
|---|---|---|---|
| JP | 01-306062 | A | 12/1989 |
| JP | 09-277015 | A | 10/1997 |
| JP | 09-323149 | A | 12/1997 |
| JP | 2000-094115 | A | 4/2000 |
| JP | 2008-260048 | A | 10/2008 |

* cited by examiner

*Primary Examiner* — Kevin P Kerns
(74) *Attorney, Agent, or Firm* — Carrier Blackman & Associates, P.C.; William D. Blackman; Joseph P. Carrier

(57) ABSTRACT

Disclosed is a cast pin equipped with circular grooves which are provided at any location. The cast pin (10) is equipped with: an outer tube (11) in the shape of a hollow body the tip of which is closed; an inner tube (20) inserted into the outer tube (11); and a cooling medium pipe (30) that is inserted into the inner tube (20) and supplies a cooling medium to the interior of the inner tube (20). Three circular grooves (22) are formed at prescribed intervals in the longitudinal direction, for example, on the outer circumferential surface (21) of the inner tube (20). The circular grooves (22) are formed in the outer circumferential surface (21) by applying a cutting tool from the radial outward direction of the inner tube (20).

6 Claims, 14 Drawing Sheets

PRIOR ART

CORE PIN FOR CASTING

TECHNICAL FIELD

The present invention relates to an improved cooled core pin.

BACKGROUND ART

A core pin is used for making a cast hole in a casting simultaneously with a casting process. Finishing a cast hole can reduce a machining allowance and the number of machining steps but also increase a material yield, as compared to machining a hole by means of a drill or the like.

However, because the core pin is inserted into a cavity and surrounded by high-temperature molten metal, a thermal load on the core pin would become great. As a measure for reducing the thermal load, a cooled (type) core pin is recommended which is cooled by a cooling medium, such as water (see, for example, Patent Literature 1). FIG. 18 hereof is a sectional view of an outer pin in the core pin disclosed in Patent Literature 1.

Referring to FIG. 18, the outer pin 100 has an annular groove 102 in its inner peripheral surface 101. Generally, such an annular groove 102 is formed by a boring method. Namely, a central hole is made in the material by means of a drill or the like. Then, a bore 105 having a blade section 104 at the distal end of a rod 103 is inserted through an inlet 106 and rotated relatively to shave off the material so as to form the annular groove 102.

It is essential that a maximum length L at the distal end of the bore 105 be smaller than a diameter of the inlet 106. The smaller the diameter of the inlet 106, the smaller becomes an outer diameter of the rod 103. As the outer diameter of the rod 103 becomes smaller, flexure is more likely to occur at the distal end of the rod 103. Therefore, with the boring method, a finishing accuracy of the annular groove 102 tends to be low. Additionally, it is difficult to provide the annular groove near the distal end 107 (remote from the inlet 106) of the outer pin 100.

However, depending on the core pin, it may sometimes be required that the annular groove 102 be also provided near the distal end 107. Thus, there has been a demand for a structure which allows the annular groove 102 to be provided at a desired position.

PRIOR ART LITERATURE

Patent Literature 1: Japanese Patent Application Laid-open Publication No. 2000-94114.

SUMMARY OF INVENTION

Technical Problem

It is therefore an object to provide an improved core pin which allows a annular groove to be readily provided at a desired position.

Solution to Problem

According to the present invention, as defined in a first aspect hereof, there is provided a core pin comprising: an outer tube in the form of a hollow tube closed at the distal end thereof; an inner tube inserted in the outer tube with the outer peripheral surface thereof contacting the inner peripheral surface of the outer tube; and a cooling medium pipe inserted in the inner tube, with a predetermined distance kept between the inner peripheral surface of the inner tube and the outer peripheral surface of the cooling medium pipe, for supplying a cooling medium into the inner tube, characterized in that the core pin includes a heat insulating chamber provided between the outer tube and the inner tube, and the heat insulating chamber is defined by an annular groove formed in the outer peripheral surface of the inner tube and the inner peripheral surface of the outer tube covering the annular tube.

Preferably, as recited in a second aspect hereof, in addition to the first aspect, the outer tube is formed of an iron-based material while the inner tube is formed of a copper based material, and a gap is provided at a normal temperature between the inner peripheral surface of the outer tube and the outer peripheral surface of the inner tube such that the outer peripheral surface of the inner tube is brought into close contact with the inner peripheral surface of the outer tube in response to pouring of a molten metal.

Preferably, as recited in a third aspect hereof, the inner tube is segmented in a zone where heat transfer is required and a zone where heat retention is required, and the zone where heat transfer is required is formed of a material of a higher thermal conductivity than a material of the zone where heat retention is required, the zone where heat transfer is required and the zone where heat retention is required being integrally joined to each other.

Preferably, as recited in a fourth aspect hereof, in addition to the third aspect, the outer tube is formed of an iron-based material, and the zone of the inner tube where heat transfer is required is formed of a copper-based material. A gap is provided at normal temperature between the inner peripheral surface of the outer tube and the outer peripheral surface of the zone where heat transfer is required such that the outer peripheral surface of the zone where heat transfer is required is brought into close contact with the inner peripheral surface of the outer tube in response to pouring of a molten metal.

Preferably, as recited in a fifth aspect hereof, in addition to the first aspect, the core pin of the present invention is adapted to be mounted to a mold for forming, around the outer tube, a small thickness portion of a product and a general thickness portion greater in thickness than the small thickness portion, and the heat insulating chamber is provided near the small thickness portion of the product.

Preferably, as recited in a sixth aspect hereof, in addition to the first aspect, the core pin of the present invention is adapted to be mounted to a mold for forming, around the outer tube, a small thickness portion of a product and a general thickness portion greater in thickness than the small thickness portion, the outer tube being inserted in a cavity of the mold in partial contact with the mold. The heat insulating chamber is provided near the small thickness portion and in a region of the outer tube where the outer tube contacts the mold.

In the invention recited in the first aspect hereof, the annular groove is formed in the outer peripheral surface of the inner tube. Such an annular groove can be formed in the outer peripheral surface of the inner tube by applying a cutting tool from radially outside of the inner tube. Unlike the conventional boring method, this method can provide the annular groove at a desired position. Also, the present invention can eliminate a need to care about flexure of the cutting tool, and a satisfactory finishing accuracy of the annular groove can be achieved.

In the invention recited in the second aspect hereof, in addition to the first aspect, the outer tube is formed of an iron-based material while the inner tube is formed of a copper-based material, and the gap is provided at normal temperature between the inner peripheral surface of the outer tube and the outer peripheral surface of the inner tube such that the outer peripheral surface of the inner tube is brought into close contact with the inner peripheral surface of the outer tube in response to pouring of the molten metal. The close contact and the gap are achieved or implemented by virtue of the thermal conductivity of the copper being about 1.5 times the thermal conductivity of the iron.

In response to the pouring of the molten metal, the inner tube is brought into close contact with the outer tube except for the annular tube, so that heat of the molten metal can be sequentially transmitted smoothly to the outer tube and then to the inner tube to be absorbed by the cooling medium.

After the molten metal solidifies, the core pin is removed from the casting as part of mold release operation. Because the inner tube continues to be cooled by the cooling medium, a gap is formed again between the outer tube and the inner tube. After that, the outer tube is not cooled any longer by the cooling medium although the inner tube continues to be cooled by the cooling medium. Thus, the cooling of the outer tube becomes much slower, so that the outer tube is supplied to a next casting process while still remaining at high temperature.

Prior to the casting, a liquid mold release agent is applied to the outer tube. This liquid mold release agent is sufficiently dried, prior to next pouring of the molten metal, by potential heat of the outer tube. If the outer tube is low in temperature, then the liquid mold release agent is scarcely dried. If the molten material is poured in this state, a liquid component included in the mold release agent would be evaporated by the heat of the molten metal, so that casting defects, such as blow holes, may be undesirably produced. The present invention can avoid such defects because there is no fear of gas being produced from the mold release agent, with the result that casting quality can be significantly enhanced.

In the invention recited in the third aspect hereof, the inner tube is segmented in the zone where heat transfer is required and the zone where heat retention is required, and the zone where heat transfer is required is formed of a material of a higher thermal conductivity than the material of the zone where heat retention is required. The zone where heat transfer is required and the zone where heat retention is required are integrally joined to each other. Because the zone where heat retention is required has a low thermal conductivity, it can achieve a desired heat retaining effect. Further, because the zone where heat transfer is required has a high thermal conductivity, it can achieve great heat transfer.

In the invention recited in the fourth aspect hereof, in addition to the third aspect, the outer tube is formed of an iron-based material, and the zone of the inner tube where heat transfer is required is formed of a copper-based material. The gap is provided at normal temperature between the inner peripheral surface of the outer tube and the outer peripheral surface of the zone where heat transfer is required such that the outer peripheral surface of the zone where heat transfer is required is brought into close contact with the inner peripheral surface of the outer tube in response to pouring of the molten metal. In response to the pouring of the molten metal, the inner tube is brought into close contact with the outer tube except for the annular tube, so that heat of the molten metal can be sequentially transmitted smoothly to the outer tube and then 5 to the inner tube to be absorbed by the cooling medium.

After the molten metal solidifies, the core pin is removed from the casting as part of mold release operation. Because the inner tube is cooled by the cooling medium, a gap is formed again between the outer tube and the inner tube. After that, the outer tube is not cooled any longer by the cooling medium although the inner tube continues to be cooled by the cooling medium. Thus, the cooling of the outer tube becomes much slower, so that the outer tube is supplied to a next casting process while still remaining at high temperature.

Prior to the casting, a liquid mold release agent is applied to the outer tube. This liquid mold release agent is sufficiently dried, prior to next pouring of the molten metal, by potential heat of the outer tube. If the outer tube is low in temperature, then the liquid mold release agent is scarcely dried. If the molten material is poured in this state, a liquid component included in the mold release agent would be evaporated by the heat of the molten metal, so that casting defects, such as blow holes, may be undesirably produced. The present invention can avoid such defects because there is no fear of gas being produced from the mold release agent, with the result that casting quality can be significantly enhanced.

In the invention recited in the fifth aspect hereof, in addition to the first aspect, the heat insulating chamber is provided near the small thickness portion of the product. In case a blow hole or the like has been formed in the general thickness portion of the product, greater in thickness than the small thickness portion of the product, at the time of machining of a screw hole or the like, inconveniences, such as bending of a drill during machining and pressure leakage, would be introduced. Thus, it is desirable that a final solidification portion be formed in a thicknesswise middle region of the great thickness portion of the product. For that purpose, it is necessary to rapidly cool a surface layer that contacts the mold. On the other hand, it is difficult to fill the molten material into the small thickness portion of the product, and thus, a heat insulating layer is provided to keep warm the small thickness portion. Thus, the present invention can cause cooling performance to differ around a single cooling pin although the thickness of the product varies.

In the invention recited in the sixth aspect hereof, in addition to the first aspect, the core pin of the present invention is a device which is mounted to the mold for forming, around the outer tube, a small thickness portion of a product and a general thickness portion greater in thickness than the small thickness portion, and in which the outer tube is inserted in the cavity of the mold in partial contact with the mold. The heat insulating chamber is provided near the small thickness portion and in the region of the outer tube where the outer tube contacts the mold.

In case a blow hole or the like has been formed in the general thickness portion of the product, greater in thickness than the small thickness portion of the product, at the time of machining of a screw hole or the like, inconveniences, such as bending of a drill during machining and pressure leakage, would be introduced. Thus, it is desirable that a final solidification portion be formed in a thicknesswise middle region of the great thickness portion of the product. For that purpose, it is necessary to rapidly cool a surface layer that contacts the mold. On the other hand, it is difficult to fill the molten material into the small thickness portion of the product, and thus, a heat insulating layer is provided to keep warm the small thickness portion. Thus, the present invention can cause cooling performance to differ around a single cooling pin although the thickness of the product varies.

DESCRIPTION OF EMBODIMENTS

Now, preferred embodiments of the present invention will be described hereinbelow with reference to the accompanying drawings. Inventions recited in claims 1 and 2 are based on FIGS. 1 to 4, inventions recited in claims 3 and 4 are based on FIGS. 5 to 8, an invention recited in claim 5 is based on FIGS. 9 to 14, and an invention recited in claim 6 is based on FIGS. 15 to 17.

Embodiment

Figure 1:
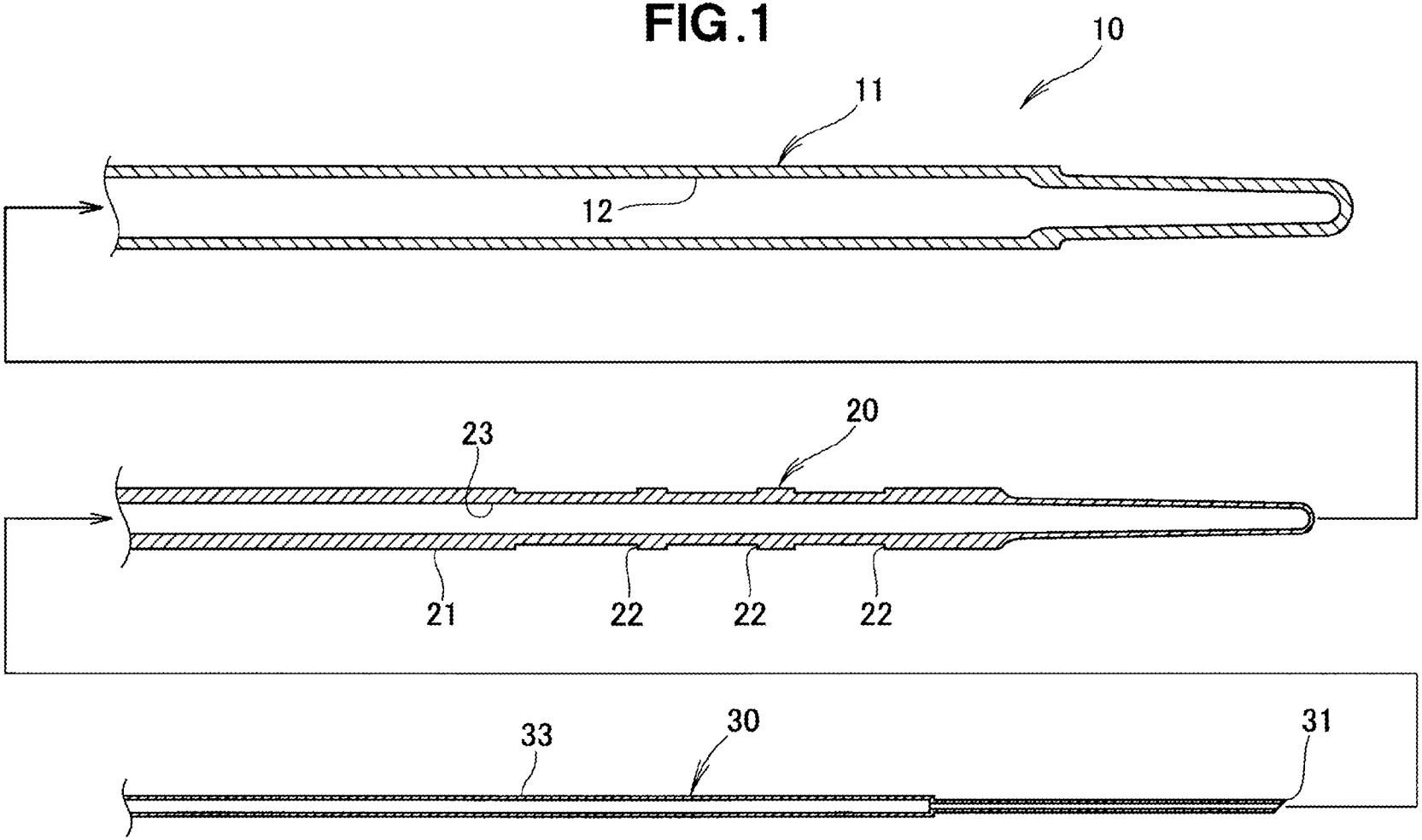
FIG. 1 is an exploded view showing a preferred embodiment of a core pin of the present invention.

As shown in FIG. 1, a preferred embodiment of a core pin 10 of the present invention comprises: an outer tube 11 in the form of a hollow tube closed at its distal end; an inner tube 20 inserted in the outer tube 11 with its outer peripheral surface 21 contacting the inner peripheral surface 12 of the outer tube 11; and a cooling medium pipe 30 inserted in the inner tube 20, with a predetermined distance (i.e., gap 32 indicated in FIG. 3) kept between the inner peripheral surface 23 of the inner tube 20 and the outer peripheral surface 33 of the cooling medium pipe 30, for supplying a cooling medium into the inner tube 20.

The inner tube 20 has a plurality of, e.g. three, annular grooves 22 formed in the outer peripheral surface 21. Such annular grooves 22 can be formed in the outer peripheral surface 21 by applying a cutting tool from radially outside of the inner tube 20. Unlike the boring method, this method can provide the annular grooves 22 at desired positions. Also, the instant embodiment can eliminate a need to care about flexure of the cutting tool, and thus, a satisfactory finishing accuracy of the annular grooves 22 can be achieved.

Figure 2:
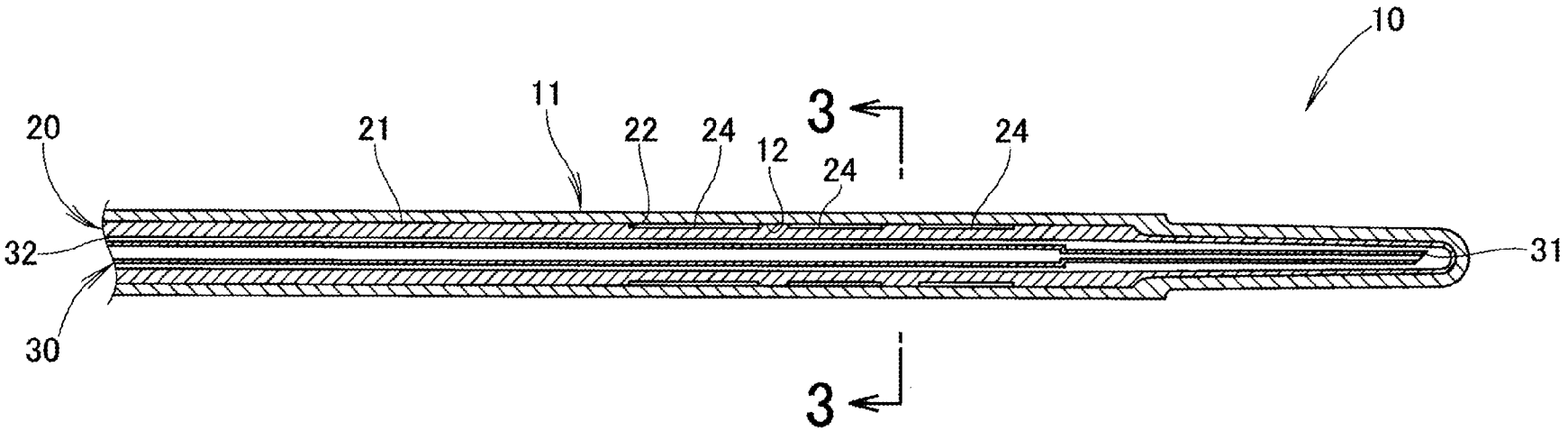
FIG. 2 is a sectional view of the core pin shown in FIG. 1.

FIG. 2 shows a finished form of the core pin 10. The annular grooves 22 formed in the outer peripheral surface of the inner tube 20 are each closed or covered with the inner peripheral surface of the outer tube 11 so that heat insulating chambers 24 each of a rectangular sectional shape are formed. A cooling medium, such as water, is caused to flow through the interior of the central cooling medium pipe 30 toward a distal end portion 31, so that the cooling medium is supplied through the distal end portion 31 into the inner tube 20. Then, the cooling medium flows backward through the gap 32 between the cooling medium pipe 30 and the inner tube 20 to thereby compulsorily cool the inner tube 20.

Figure 3:
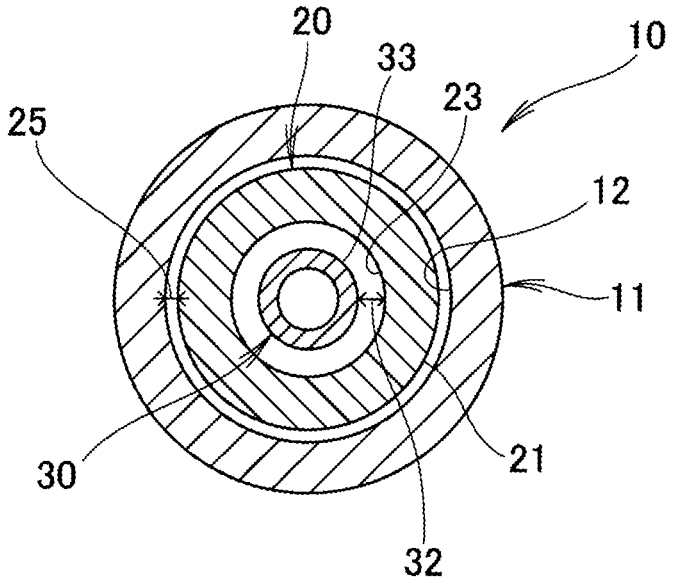
FIG. 3 is an enlarged sectional view taken along line 3-3 of FIG. 2.
Figure 4:
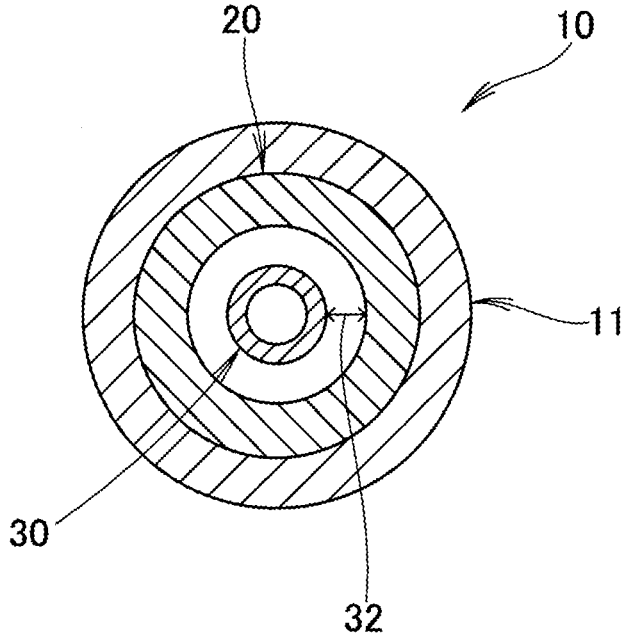
FIG. 4 is a sectional view showing a state where a gap has been formed between an outer tube and an inner tube after pouring of a molten metal.

At normal temperature, a gap 25 is provided between the inner peripheral surface 12 of the outer tube 11 and the outer surface 21 of the inner tube and a gap 32 is provided between the inner peripheral surface 23 of the inner tube 20 and the outer peripheral surface 33 of the cooling medium pipe 30, as shown in FIG. 3. The inner tube 20 is preferably formed of copper alloy, and a heat expansion coefficient of the copper alloy is $17.7\times10^{-6}$ (mm/mm·K) while a thermal conductivity of the copper alloy is 372 (W/m·K).

The outer tube 11 is preferably formed of steel, and a heat expansion coefficient of the hot tool steel is $12.1\times10^{-6}$ (mm/mm·K) while a thermal conductivity of the hot tool steel is 372 (W/m·K).

In FIG. 3, if the outer tube 11 is surrounded by high-temperature molten aluminum of 660° C. or over, the outer tube 11 gets hot, in response to which the temperature of the inner tube 20 increases. Let it be assumed that the outer tube 11, whose inner diameter is 10 mm at normal temperature, has reached 400 C.

The inner peripheral surface of the outer tube 11 has a circumference (peripheral length) of 10p (mm) at normal temperature (25° C.). At 400° C., the inner peripheral surface has a circumference of $10.045\pi$ (mm), which can be determined by performing a calculation of $10\pi\ (1+12.1\times10^{-6}\times(400-25))=10\pi\times1.0045=10.045\pi$. By converting the circumference into a diameter, it is determined that the inner diameter of the outer tube 11 is 10.045 mm at 400° C.

The inner tube 20, on the other hand, is cooled by the cooling medium, but it is expected that, at a time point immediately after pouring of the molten metal, the temperature of the inner tube 12 increases up to about 400° C. that is generally the same temperature as the inner peripheral surface of the outer tube 11. Let's assume here that the outer diameter of the inner tube 20 is 9.98 mm at normal temperature and the inner tube 20 has reached a temperature of 400° C.

The outer peripheral surface of the inner tube 20 has a circumference of $9.98\pi$ (mm) at normal temperature (25° C.). At 400° C., the outer peripheral surface has a circumference of $10.046\pi$ (mm), which can be determined by performing a calculation of $9.98\pi(1+17.7\times10^{-6}\times(400-25))=9.98\pi\times1.0066=10.046\pi$. By converting the circumference into a diameter, it is determined that the outer diameter of the inner tube 20 is 10.046 mm at 400° C. Such an outer diameter of the inner tube 20 is very approximate to the inner diameter (10.045 mm) of the outer tube 11.

By a calculation of $(10-9.98)/2=0.01$, a gap 25 of 1/100 mm is secured between the outer tube 11 and the inner tube 20 at normal temperature.

After the pouring of the molten metal, the gap disappears due to a difference between the thermal expansion coefficients, so that heat transfer from the outer tube 11 to the inner tube 20 becomes active or is promoted and thus a temperature increase of the outer tube 11 can be suppressed.

Figure 5:
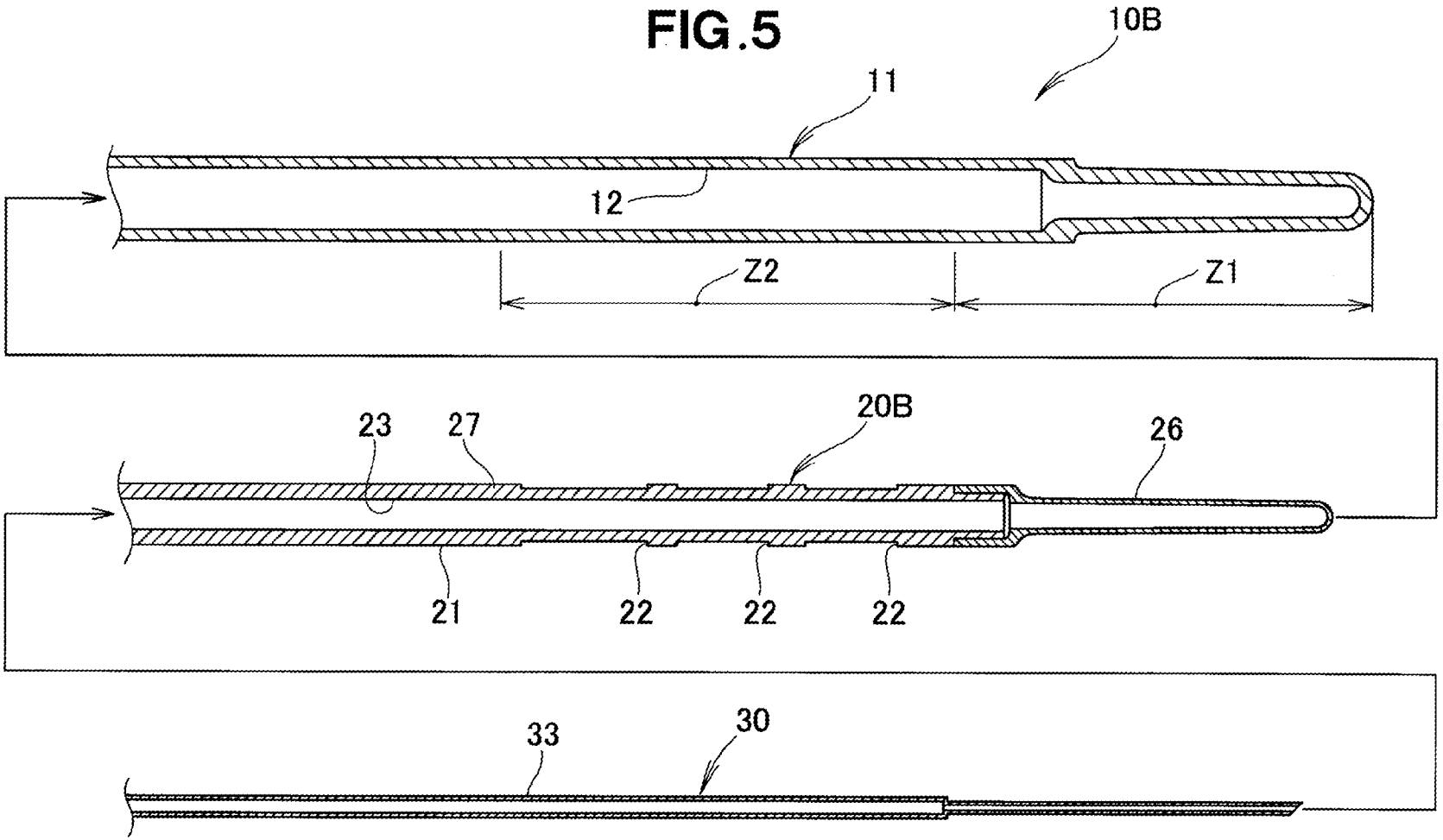
FIG. 5 is an exploded view of a modification of the core pin shown in FIG. 1.

The following describe, with reference to FIGS. 5 to 8, a modification or modified embodiment of the core pin of the present invention. As shown in FIG. 5, the modification of the core pin 10B comprises: the outer tube 11 in the form of a hollow tube closed at its distal end an inner tube 20B inserted in the outer tube 11 with its outer peripheral surface 21 contacting the inner peripheral surface 12 of the outer tube 11*i* and a cooling medium pipe 30 inserted in the inner tube 20B, with a predetermined distance (i.e., gap 32 indicated in FIG. 7) kept between the inner peripheral surface 23 of the inner tube 20B and the outer peripheral surface 33 of the cooling medium pipe 30, for supplying a cooling medium into the inner tube 20B.

The outer tube 11 is formed of hot tool steel whose heat expansion coefficient is $12.1\times10^{-6}$ (mm/mm·K). Further, because of requirements of a casting, the outer tube 11 is segmented in a zone Z1 where heat transfer is required in an axial direction of the tube and a zone Z2 where heat retention is required. Of the inner tube 20B, a portion of the zone Z1 where heat transfer is required is in the form of a cap 26 formed of copper, and a part corresponding to the zone Z2 where heat retention is required is in the form of a stainless pipe 27. More specifically, the cap 26 is fitted over and brazed to an end portion of the stainless pipe 27, so that the cap 26 and the stainless pipe 27 are integrated together. The other structural elements in the modification are identical to, and thus depicted by the same reference numerals as, those in the embodiment of FIG. 1 and will not be described here to avoid unnecessary duplication.

Figure 6:
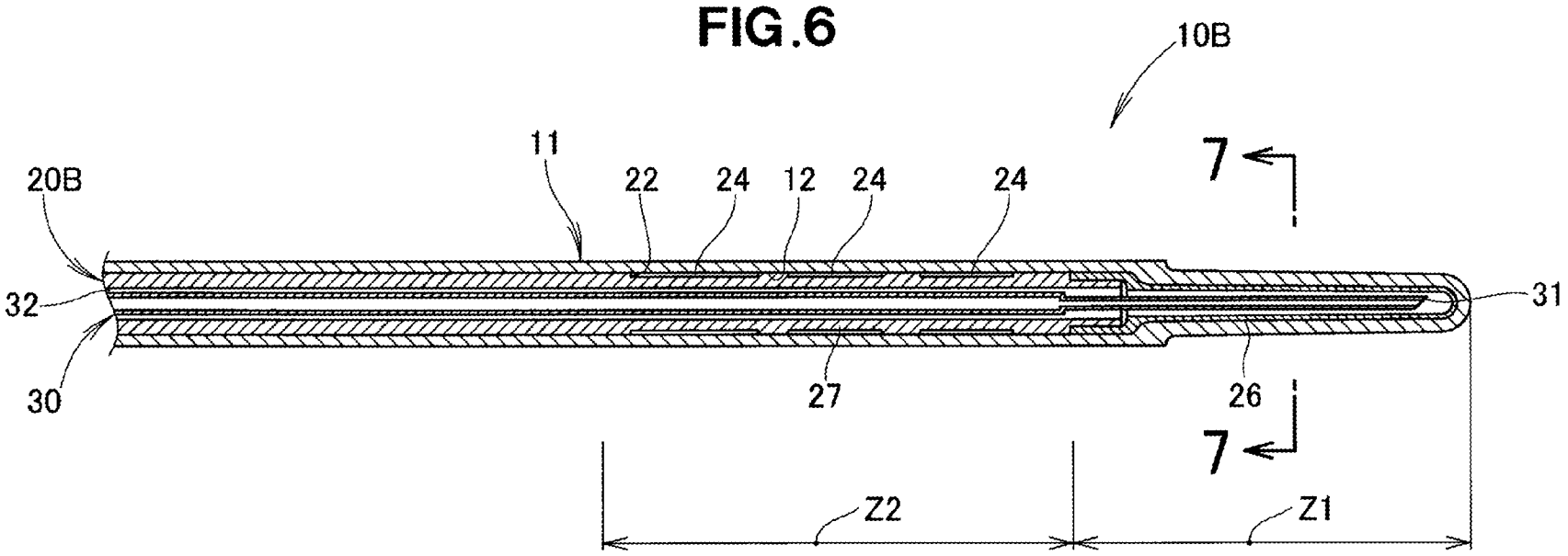
FIG. 6 is a sectional view of the modification of the core pin shown in FIG. 5.

FIG. 6 shows a finished form of the core pin 10B. The annular grooves 22 formed in the outer peripheral surface of the inner tube 20B are each closed or covered with the inner peripheral surface 12 of the outer tube 11 so that the heat insulating chamber 24 of a rectangular sectional shape is formed. A cooling medium, such as water, is caused to flow through the interior of the central cooling medium pipe 30 toward the distal end portion 31, so that the cooling medium is supplied through the distal end portion 31 into the inner tube 20. Then, the cooling medium flows backward through the gap between the cooling medium pipe 30 and the inner tube 20B to thereby compulsorily cool the inner tube 20B. The outer tube 11 is cooled by the inner tube 20B.

The copper alloy forming the cap 26 has a thermal conductivity of 372 (W/m·K), and the stainless tube 27 has a thermal conductivity of 16.7 (W/m·K) and is SUS304. Because the thermal conductivity of the stainless tube 27 is 1/20 (one twentieth) or less of the thermal conductivity of the cap 26 and additionally the stainless tube 27 has the heat insulating chambers 24, the stainless tube 27 has a low thermal conductivity property. Namely, the stainless tube 27 has a superior heat retention performance and thus is well suited as the zone Z2 where heat retention is required. Further, because the thermal conductivity of the cap 26 is twenty times or more of the thermal conductivity of the stainless tube 27, the cap 26 has a superior thermal conductivity property and thus is well suited as the zone Z1 where heat transfer is required.

Figure 7:
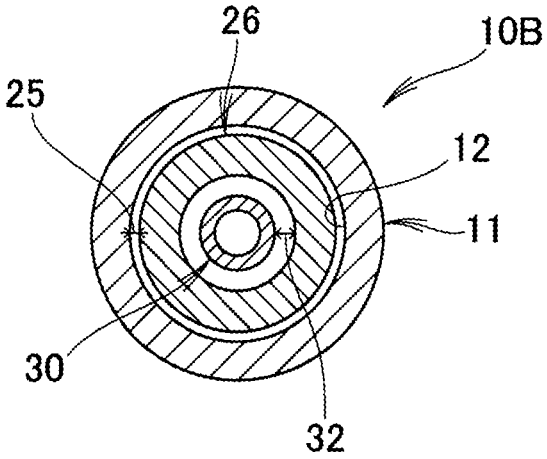
FIG. 7 is an enlarged sectional view taken along line 7-7 of FIG. 6.
Figure 8:
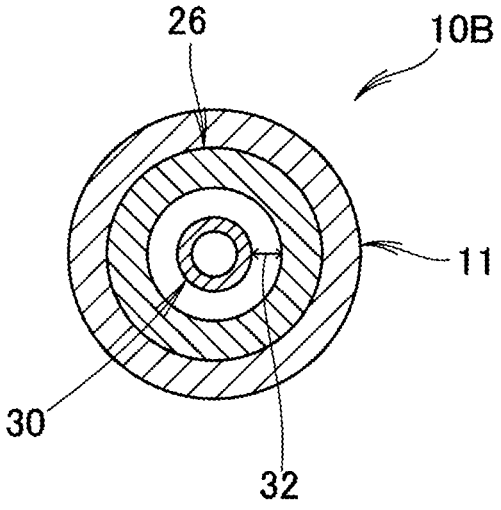
FIG. 8 is a sectional view showing a state where a gap has been formed between the outer tube and the inner tube after pouring of the molten metal.

At normal temperature, a gap 25 of about 1/100 (0.01 mm) is provided between the outer tube 11 and the cap 26, as shown in FIG. 7. Further, in response to pouring of the molten metal, the cap 26 is brought into close contact with the outer tube 11 due to a difference between the thermal expansion coefficients as shown in FIG. 8, so that heat transfer from the outer tube 11 to the cap 26 becomes active and thus a temperature increase of the outer tube 11 can be suppressed.

Figure 9:
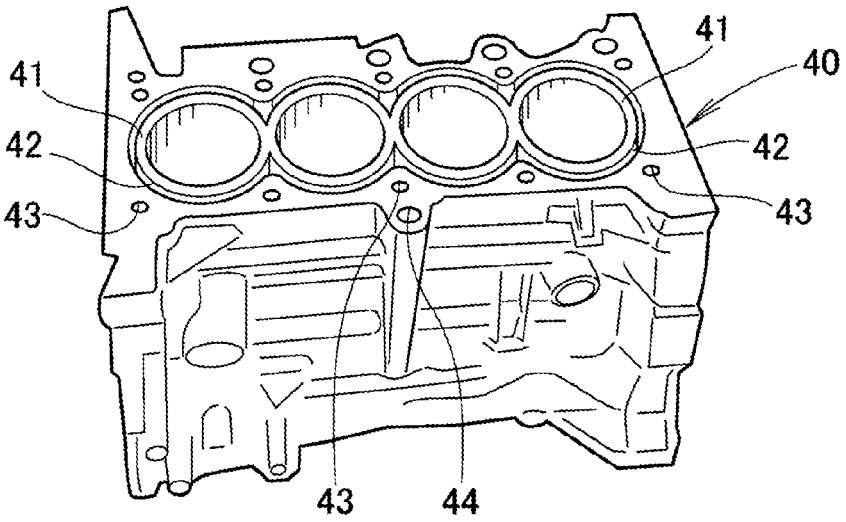
FIG. 9 is a perspective view of a cylinder block.

Further, FIG. 9 shows a cylinder block 40 that is a typical example of a casting. The cylinder block 40 includes a water jacket 42 around the periphery of a cylinder liner 41, a plurality of (ten in the illustrated example) of bolt holes 43, and an oil passage 44 located outside the bolt holes 43.

Figure 10:
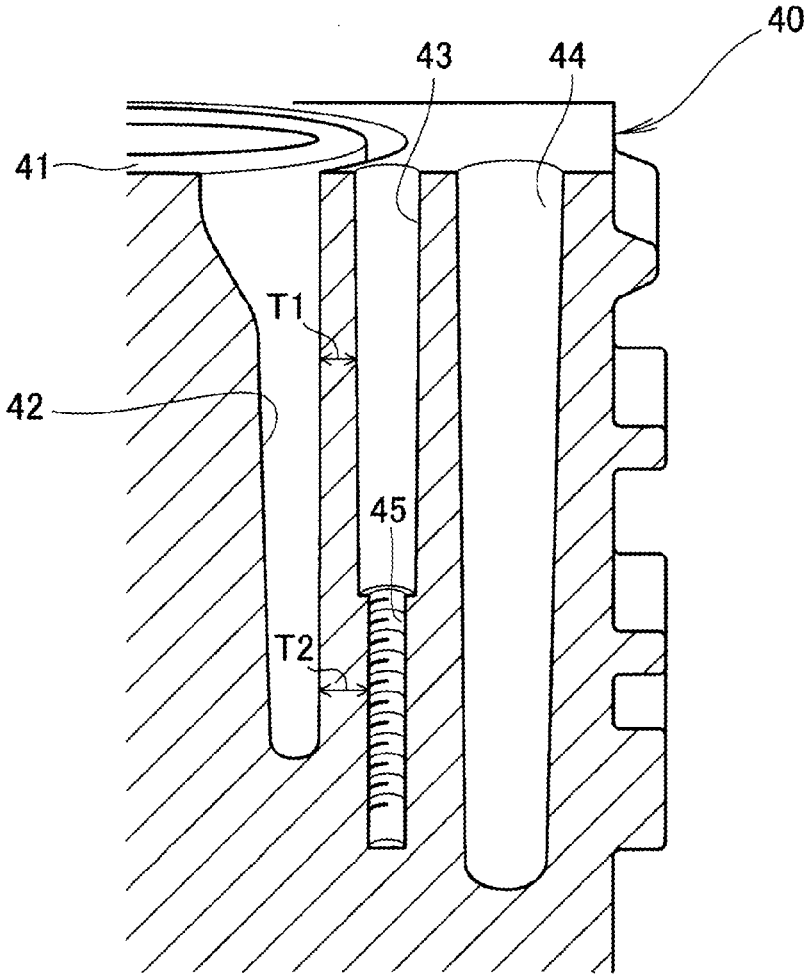
FIG. 10 is a partly enlarged sectional view of a cylinder block.

Further, as shown in FIG. 10, each of the bolt holes 43 has an internal thread portion 45 formed in a distal end portion of the bolt hole 43. Thus, the distal end portion of the bolt hole 43 has a smaller diameter than the other portion of the bolt hole 43. Consequently, a thickness T2 in the neighborhood of the internal thread portion 45 is greater than a thickness T1 of the other portion.

Figure 11:
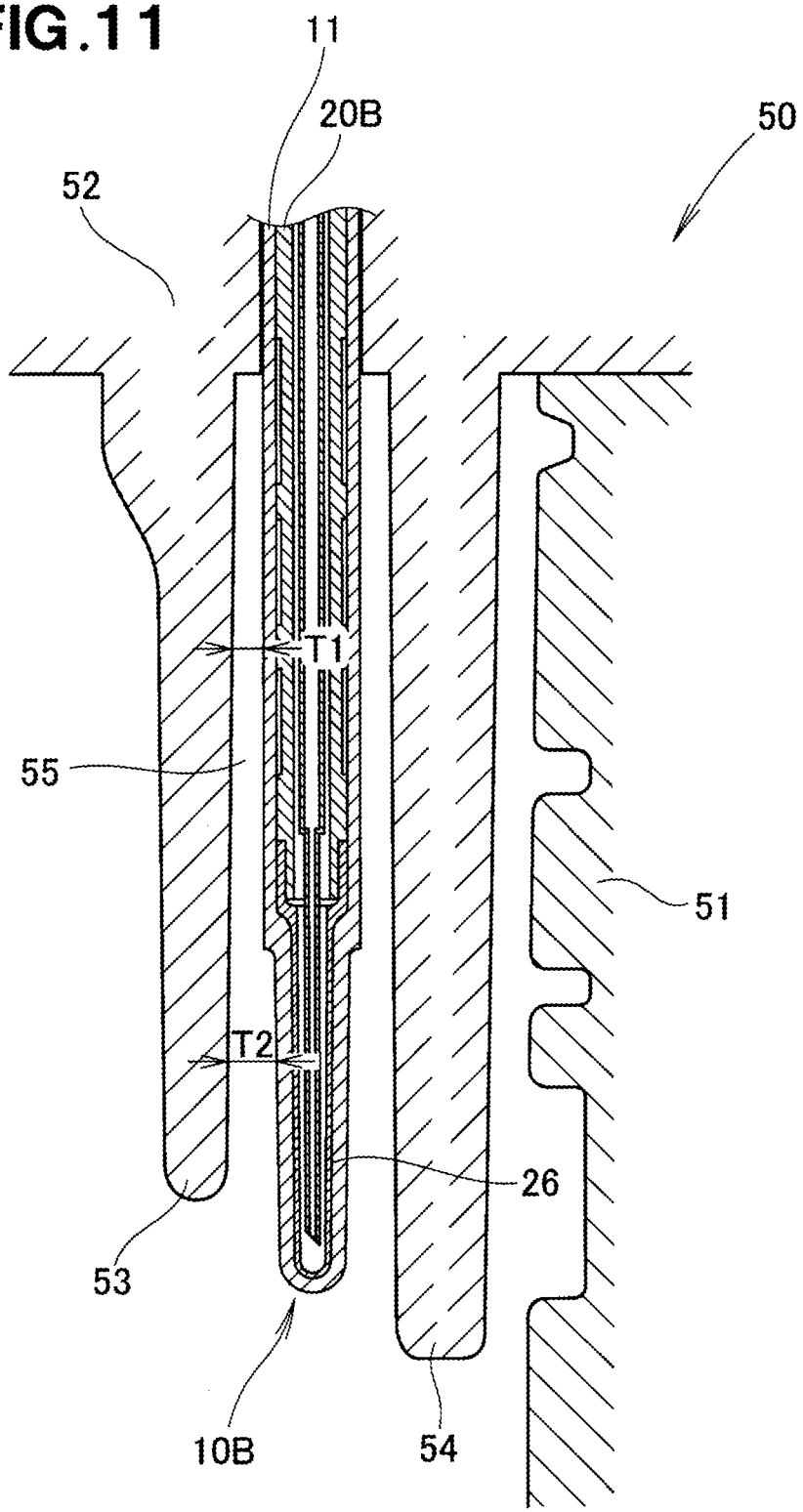
FIG. 11 is a partly enlarged sectional view of a cylinder block casting mold.
Figure 12:
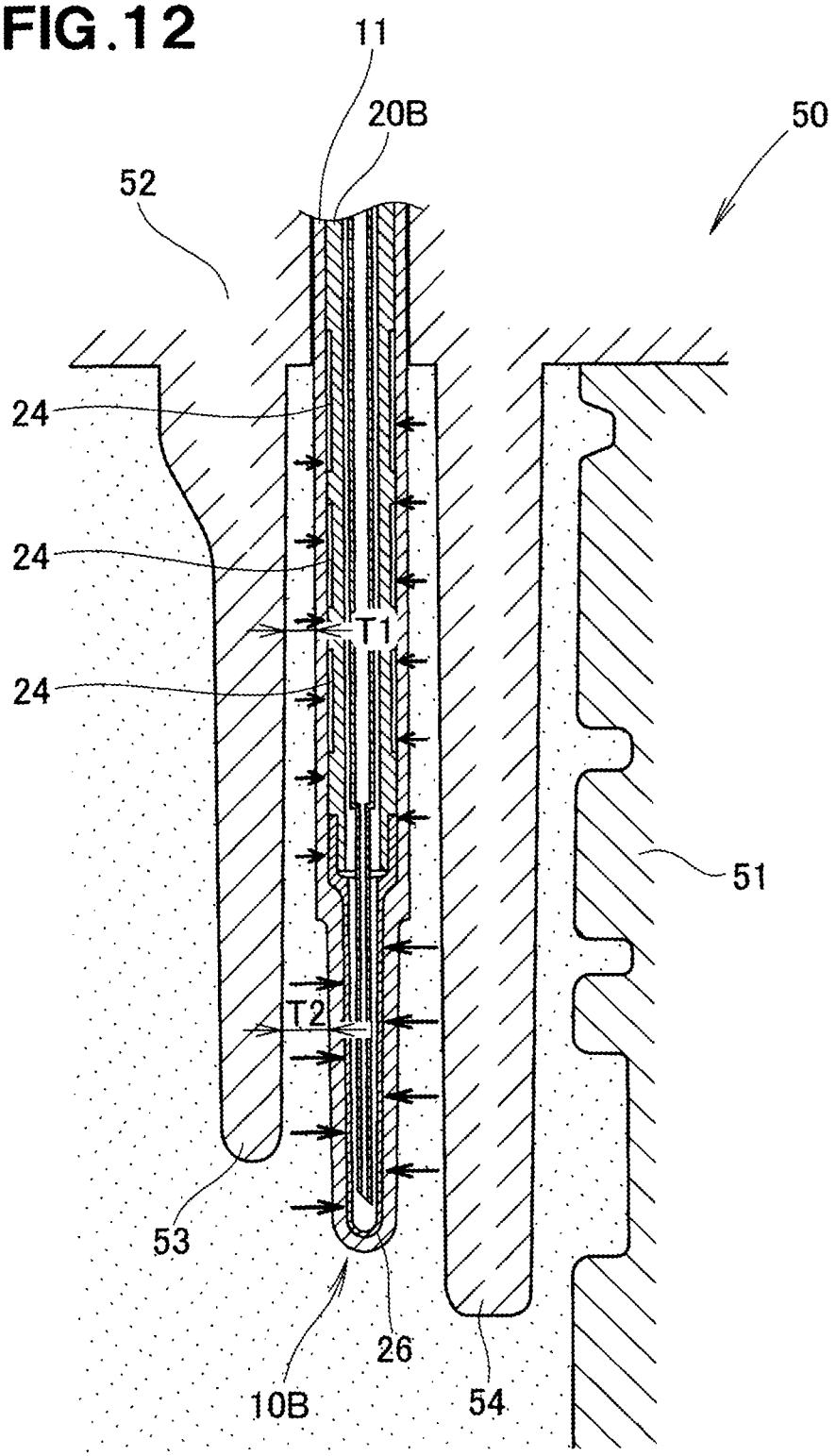
FIG. 12 is a sectional view showing a state where the molten metal has been poured into a cavity of the mold shown in FIG. 11.

Next, a description will be given about a construction of a mold for casting the aforementioned cylinder block 40. As shown in FIG. 11, the cylinder block casting mold 50 includes a side mold 51 surrounding the side surface of the cylinder block, and a movable mold 52 put over the side mold 51. The movable mold 52 has a water-jacket forming section 53 and an oil-passage forming section 54 each projecting from the body of the mold 52, and the core pin device 10B is provided between the water-jacket forming section 53 and the oil-passage forming section 54. The movable mold 52 also has a cavity 55 surrounding the core pin device 10B, and a width T2 of a gap in a distal end portion of the cavity 55 is greater than a width T1 of the other portion of the cavity 55.

Because the heat insulating chambers 24 are provided between the outer tube 11 and the inner tube 20B, heat transfer is limited in a region of the gap width T1 when molten aluminum is poured into the cavity 55. In a region of the gap width T2, however, heat transfer is promoted because the cap 26 is formed of copper having a high thermal conductivity.

Generally, if a blow hole exists near a surface layer of a great thickness portion, the following inconveniences would occur. Namely, if a screw hole or the like is machined, the screw hole would communicate with the blow hole to cause an unwanted pressure leakage. Also, a drill would bend during the machining.

Therefore, according to the present invention, the great thickness portion, i.e. general thickness portion, is cooled rapidly. Then, a chill layer is formed in the surface layer. The chill layer has not only good workability but also fine density, and thus, even if a blow hole exists in a thicknesswise middle region, there is no fear of the blow hole undesirably communicating with a hole. Besides, there is no fear of the drill undesirably bending. Thus, in the present invention, the great thickness portion, i.e. general thickness portion, is cooled rapidly with a view to causing the thicknesswise middle region to become a final solidification portion.

On the other hand, it is difficult to fill the molten metal into a small thickness portion because a cavity space is narrow. If the solidification progresses before the molten metal is filled into every corner of the cavity space, unwanted underfill tends to occur. Thus, the present invention is constructed to keep warm a small thickness portion of a product by means of the heat insulating chambers and thereby suppress a temperature decrease of the molten metal. Keeping warm the small thickness portion as above can secure a molten metal flow and thereby prevent occurrence of underfill.

Namely, in case a blow hole or the like has been formed in a general thickness portion of a product, greater in thickness than a small thickness portion of the product, during machining of a screw hole or the like, introduce inconveniences, such as bending of a drill during machining and pressure leakage, would be introduced. Thus, it is desirable that a final solidification portion be formed in a thicknesswise middle region of a great thickness portion of the product. For that purpose, it is necessary to rapidly cool a surface layer that contacts the mold. On the other hand, it is difficult to fill the molten material into a small thickness portion of a product, and thus, a heat insulating layer is provided to keep warm the small thickness portion. Thus, the present invention can cause cooling performance to differ around a single cooling pin although the thickness of the product varies, for example, in the range of T1-T2.

Figure 13:
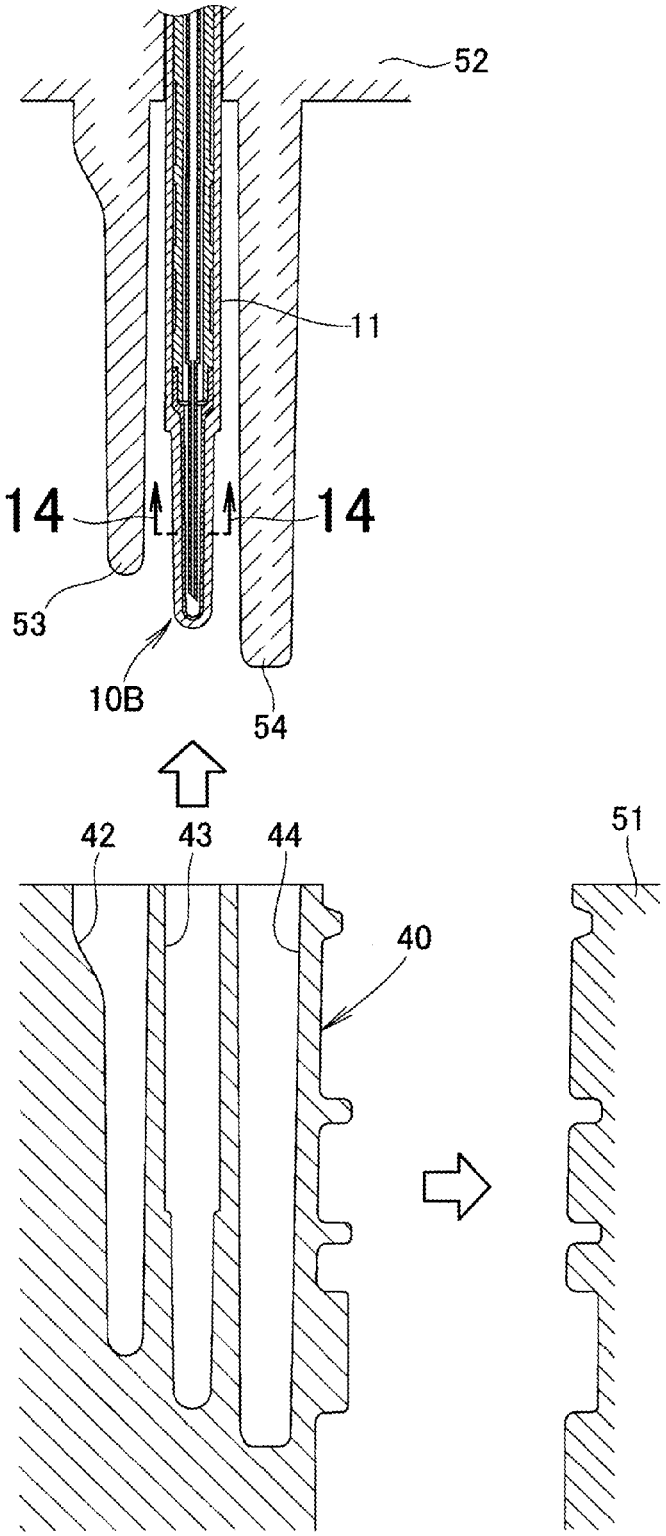
FIG. 13 is an exploded sectional view showing a state where the mold has been released from the state of FIG. 12.

After the molten metal has solidified, the side mold 51 and the movable mold 52 are detached from the cylinder block 40 as indicated by arrows in FIG. 13.

For a period from the time of molten metal pouring to an initial cooling stage, heat of the molten metal actively transfers to the outer tube 11 and the cap 26, and then the cap 26 is kept in close contact with the outer tube 11 due to a difference between the thermal expansion coefficients.

For a period from an end stage of the casting cycle to mold opening, the heat transfer (i.e., heat absorption) to the outer tube decreases dramatically due to temperature decrease or solidification of the molten metal. The cap 26, on the other hand, is cooled by the cooling medium.

Let's now assume that the temperature of the inner peripheral surface of the outer tube 11 has decreased to 300° C. At 300° C., the inner peripheral surface has a circumference of 10.033π (mm), which can be determined by performing a calculation of $10\pi(1+12.1\times10^{-6}\times(300-25))=10\pi\times1.0033=10.033\pi$. The circumference can be converted into a diameter of 10.033 mm, which is indicative of an inner diameter of the outer tube 11 at 300° C.

Because the cap 26 is cooled by the cooling medium, the cap 26 is expected to have a temperature of about 100° C. At 100° C., the outer peripheral surface of the cap 26 has a circumference of 9.993π (mm), which can be determined by performing a calculation of $9.98\pi(1+17.7\times10^{-6}\times(100-25))=9.993\pi$. By converting the circumference into a diameter, it is determined that the outer diameter of the cap 26 is 9.993 mm at 100° C.

Figure 14:
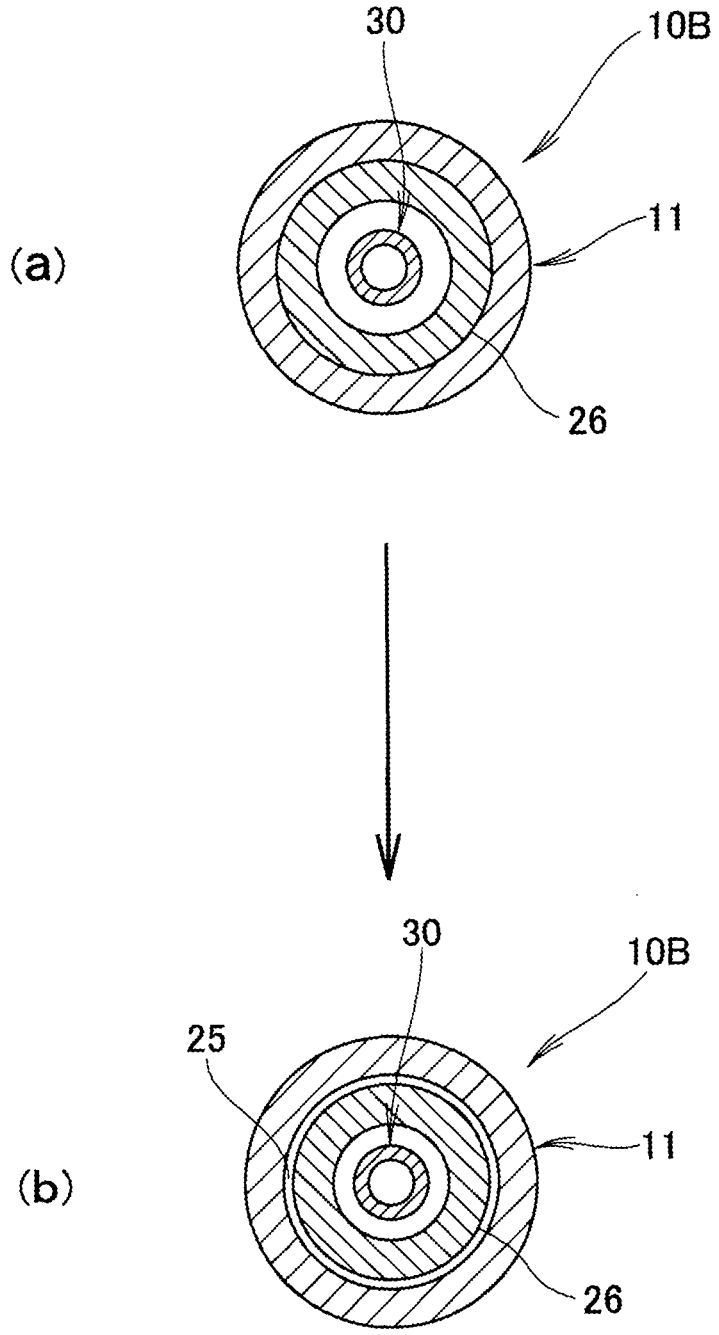
FIG. 14 is an enlarged sectional view taken along line 14-14 of FIG. 13.

By a calculation of (the inner diameter of the outer tube—the outer diameter of the cap)/2=(10.033−9.993)/2=0.02, a gap 25 of 0.02 mm is formed as shown in (b) of FIG. 14. Because this gap 25 performs a heat insulating function or action, only the cap 26 is cooled by the cooling medium, so that the gap 25 gets bigger. However, the outer tube 11 does not decrease in temperature so much because of the presence of the gap 25.

In FIG. 13, the outer tube 11 is supplied to a next casting process while still remaining at high temperature. Prior to the casting, a liquid mold release agent is applied to the outer tube 11. This liquid mold release agent is sufficiently dried, prior to next pouring of the molten metal, by potential heat of the outer tube 11.

If the outer tube 11 is low in temperature, then the liquid mold release agent is scarcely dried. If the molten material is poured in this state, a liquid component included in the mold release agent is evaporated by the heat of the molten metal, so that casting defects, such as blow holes, may be undesirably produced.

With the present invention, however, the mold release agent can be sufficiently dried by the potential heat of the outer tube prior to next pouring of the molten metal and thus there is no fear of gas being produced from the mold release agent, with the result that casting quality can be significantly enhanced.

In FIG. 5, the modified inner tube 20B comprises the cap 26 formed of copper alloy, and the stainless pipe 27. The heat expansion coefficient of the copper alloy is $17.7\times10^{-6}$ (mm/mm·K), while the heat expansion coefficient of the stainless pipe 27 is $17.6\times10^{-6}$ (mm/mm·K). There is almost no difference in heat expansion coefficient between the stainless pipe 27 and the cap 26.

As a consequence, the same action as described above in relation to (a) and (b) of FIG. 14 occurs between the iron-based outer tube 11 and the stainless pipe 27. Namely, the iron-based outer tube 11 and the stainless pipe 27 are brought into close contact each other in response to pouring of the molten metal as shown in (a) of FIG. 14 and the gap 25 is formed again after solidification of the casting as shown in (b) of FIG. 14, so that a high temperature of the outer tube 11 can be maintained.

Figure 15:
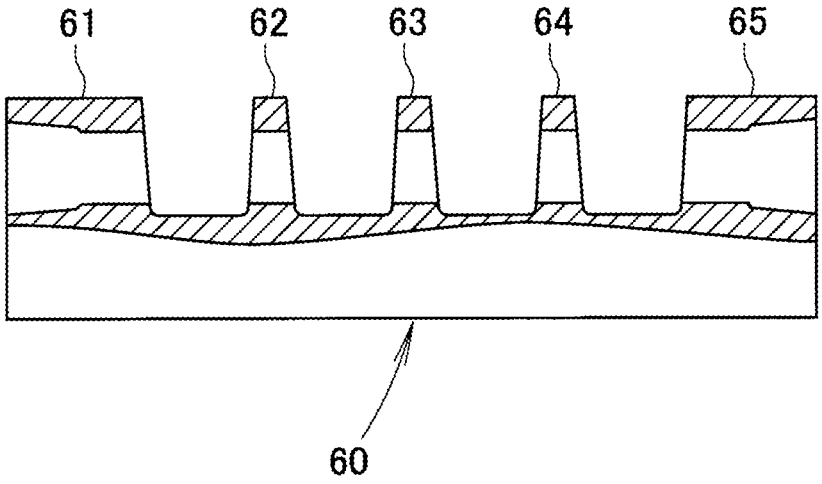
FIG. 15 is a sectional view of a cylinder head.

The following describe an instance where the basic principles of the present invention are applied to a cylinder head that is another typical example of a casting. As shown in FIG. 15, the cylinder head 60 includes first to fifth shaft support sections 61 to 65 for supporting cam shafts. As shown, the first shaft support section 61 and the fifth shaft support section 65 have a great volume and thus will hereinafter be referred to as "general thickness portions". The second to fourth shaft support sections 62 to 64, on the other hand, have a smaller volume than the general thickness portions and thus will hereinafter be referred to as "small thickness portions of a product" or "product's small thickness portions".

Figure 16:
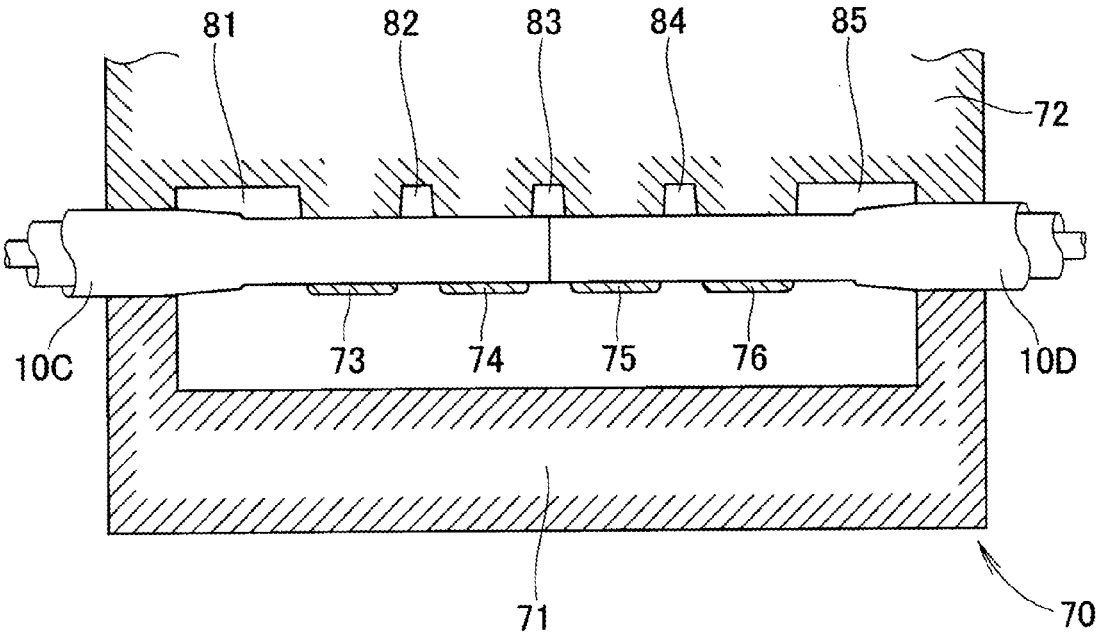
FIG. 16 is a sectional view of a mold for casting the cylinder head shown in FIG. 15.

A cylinder head casting mold 70 shown in FIG. 16 is used to cast such a cylinder head 60. Namely, the cylinder head casting mold 70 comprises lower and upper molds 71 and 72, and first to fourth protrusions 73 to 76 are provided on the upper mold 72.

A first (leftmost in FIG. 16) cavity 81 defined by the first protrusion 73 and a fifth (rightmost in FIG. 16) cavity 85 defined by the fourth protrusion 76 are used to form the general thickness portions. Further, a second cavity 82 defined between the first protrusion 73 and the second protrusion 74, a third cavity 83 defined between the second protrusion 74 and the third protrusion 75 and a fourth cavity 84 defined between the third protrusion 75 and the fourth protrusion 76 are used to form the small thickness portions of a product.

Further, core pin devices 10C and 10D are inserted through the cylinder head casting mold 70 from left and right sides respectively of the cylinder head casting mold 70 so as to pass through the first to fifth shaft support sections 61 to 65.

Figure 17:
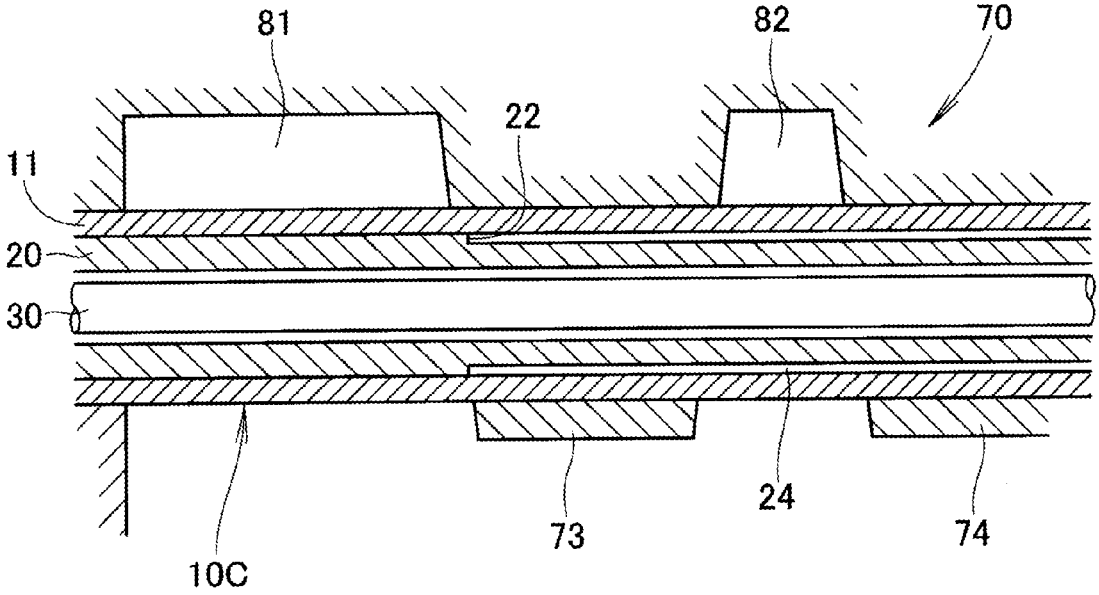
FIG. 17 is a partly enlarged sectional view of the cylinder head casting mold shown in FIG. 16.
Figure 18:
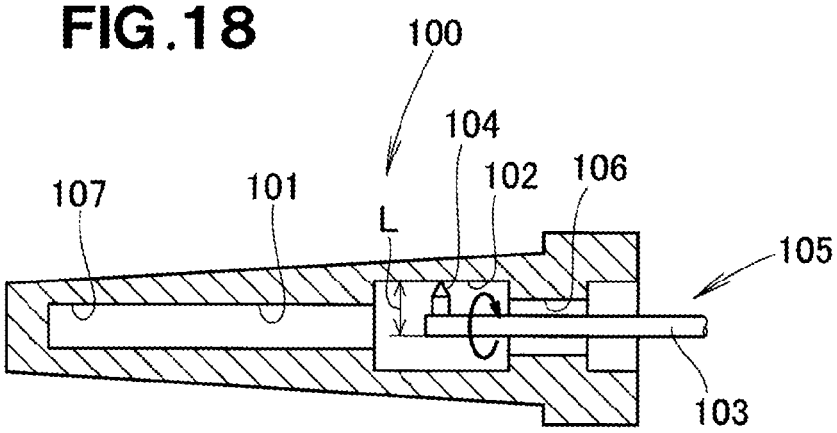
FIG. 18 is a sectional view of an outer pin in a conventionally-known core pin.

The following detail, with reference to FIG. 17, the left core pin 10C and the mold 70. However, the right core pin 10D and relationship between the right core pin 10D and the mold 70 will not be described here because the right core pin 10D is identical in construction to the left core pin 10C.

As shown in FIG. 17, the core pin 10C comprises the outer tube 11, the inner tube 20 and the cooling medium pipe 30 similarly to the aforementioned, but the annular groove 22 is provided in regions corresponding to the second cavity 82 and contacting the first and second protrusions 73 and 74 without being provided in a region corresponding to the first cavity 81.

Namely, the core pin 10C is mounted to the mold 70 capable of forming, around the outer tube 11 of the core pin 10C, a product's small thickness portion (formed by the second cavity 82) and a general thickness portion (formed by the second cavity 81) greater in thickness than the product's small thickness portion, and the outer tube 11 is inserted in the mold cavity in partial contact with the mold (first and second protrusions 73 and 74). Further, the heat insulating chamber 24 is provided near the small thickness portion corresponding to the second cavity 82 and in a region of the outer tube where the outer tube contacts the mold (more specifically, the first and second protrusions 73 and 74).

In case a blow hole or the like has been formed in a general thickness portion of a product, greater in thickness than a small thickness portion of the product, during machining of a screw hole or the like, inconveniences, such as bending of a drill during machining and pressure leakage, would be introduced. Thus, it is desirable that a final solidification portion be formed in a thicknesswise middle region of the great thickness portion of the product. For that purpose, it is necessary to rapidly cool a surface layer that contacts the mold. On the other hand, it is difficult to fill the molten metal into the product's small thickness portion, thus, the present invention is constructed to keep warm the product's small thickness portion by means of the heat insulating layer. As a result, the present invention can cause cooling performance to differ around the single cooling pin although the thickness of the product varies.

Whereas the embodiments of the core pin of the present invention have been described as applied to a casting process of a cylinder block or cylinder head, the present invention may be applied to casting processes of other castings.

INDUSTRIAL APPLICABILITY

The core pin of the present invention is well suited for application to casting of cylinder blocks.

LEGEND

10, 10B, 10C, 10D . . . core pin, 11 . . . outer tube, 12 . . . inner peripheral surface of the outer tube, 20, 20B . . . inner tube, 21 . . . outer peripheral surface of the inner tube, 22 . . . annular groove, 23 . . . inner peripheral surface of the inner tube, 24 . . . heat insulating chamber, 25 . . . gap between the outer tube and the inner tube, 30 . . . cooling medium pipe, 32 . . . gap between the inner tube and the cooling medium pipe, 33 . . . outer peripheral surface of the cooling medium pipe, 50 . . . mold (cylinder block casting mold), 70 . . . mold (cylinder head casting mold), Z1 . . . zone where heat transfer is required, Z2 . . . zone where heat retention is required

The invention claimed is:

1. A core pin for casting comprising:

an outer tube in a form of a hollow tube closed at a distal end thereof;

an inner tube inserted in the outer tube with an outer peripheral surface thereof contacting an inner peripheral surface of the outer tube;

and a cooling medium pipe inserted in the inner tube, with an annular gap defined between an inner peripheral surface of the inner tube and an outer peripheral surface of the cooling medium pipe, for supplying a cooling medium from a distal end thereof into the inner tube while allowing the cooling medium to flow backward through the annular gap to thereby cool the inner tube, wherein the core pin includes a heat insulating chamber provided between the outer tube and inner tube, and the heat insulating chamber is defined by an annular groove formed in an outer peripheral surface of the inner tube and the inner peripheral surface of the outer tube covering the annular groove, wherein the inner tube is segmented in a first axial zone where heat transfer is required and a second axial zone where heat retention is required, the first axial zone is formed of a material of a higher thermal conductivity than a material of the second axial zone, the first axial zone and the second axial zone are integrally and directly joined to each other, and the annular groove forming part of the heat insulating chamber is provided in the second axial zone, wherein the material of the first axial zone of the inner tube has a higher thermal expansion coefficient than a material of the outer tube, and wherein a gap is defined at a normal temperature between the inner peripheral surface of the outer tube and the outer peripheral surface at the first axial zone of the inner tube, such that the outer peripheral surface at the first axial zone of the inner tube is brought into close contact with the inner peripheral surface of the outer tube upon casting, due to the difference in the thermal expansion coefficient between the outer tube and the first axial zone of the inner tube.

2. The core pin according to claim 1, wherein the outer tube is formed of an iron-based material and the first axial zone of the inner tube is formed of a copper-based material.

3. The core pin of claim 1, wherein the material of the second axial zone of the inner tube has a thermal expansion coefficient nearly equal to the thermal expansion coefficient of the material of the first axial zone, and a gap is also defined at the normal temperature between the inner peripheral surface of the outer tube and the inner peripheral surface at the second axial zone of the inner tube such that the outer peripheral surface at the second axial zone of the inner tube is brought into close contact with the inner peripheral surface of the outer tube upon casting, due to a difference in the thermal expansion coefficient between the outer tube and the second axial zone of the inner tube.

4. The core pin of claim 3, wherein the outer tube is formed of an iron-based material, the first axial zone of the inner tube is formed of a copper-based material, and the second axial zone of the inner tube is formed of an iron-based material.

5. A core pin for casting comprising:

an outer tube in a form of a hollow tube closed at a distal end thereof;

a single inner tube inserted in the outer tube with an outer peripheral surface thereof contacting an inner peripheral surface of the outer tube; and a cooling medium pipe inserted in the inner tube, with an annular gap defined between an inner peripheral surface of the inner tube and an outer peripheral surface of the cooling medium pipe, for supplying a cooling medium from a distal end thereof into the inner tube while allowing the cooling medium to flow backward through the annular gap to thereby cool the inner tube, wherein the core pin includes a heat insulating chamber provided between the outer tube and the inner tube, and the heat insulating chamber is defined by an annular groove formed in an outer peripheral surface of the inner tube and the inner peripheral surface of the outer tube covering the annular groove, and wherein the inner tube is formed of a material having a higher thermal expansion coefficient than a material of the outer tube, wherein the core pin is adapted to be mounted to a mold for forming, around the outer tube, a small thickness portion of a product and a general thickness portion greater in thickness than the small thickness portion, and wherein the heat insulating chamber is provided near the small thickness portion of the product.

6. A core pin for casting comprising:

an outer tube in a form of a hollow tube closed at a distal end thereof;

a single inner tube inserted in the outer tube with an outer peripheral surface thereof contacting an inner peripheral surface of the outer tube; and a cooling medium pipe inserted in the inner tube, with an annular gap defined between an inner peripheral surface of the inner tube and an outer peripheral surface of the cooling medium pipe, for supplying a cooling medium from a distal end thereof into the inner tube while allowing the cooling medium to flow backward through the annular gap to thereby cool the inner tube, wherein the core pin includes a heat insulating chamber provided between the outer tube and the inner tube, and the heat insulating chamber is defined by an annular groove formed in an outer peripheral surface of the inner tube and the inner peripheral surface of the outer tube covering the annular groove, and wherein the inner tube is formed of a material having a higher thermal expansion coefficient than a material of the outer tube, wherein the core pin is adapted to be mounted to a mold for forming, around the outer tube, a small thickness portion of a product and a general thickness portion greater in thickness than the small thickness portion, the outer tube being inserted in a cavity of the mold in partial contact with the mold, and wherein the heat insulating chamber is provided near the small thickness portion and in a region of the outer tube where the outer tube contacts the mold.

* * * * *